US005622415A

United States Patent [19]

Felsenthal et al.

[11] Patent Number: 5,622,415

[45] Date of Patent: Apr. 22, 1997

[54] PORTABLE WARDROBE FRAME

[76] Inventors: Donald H. Felsenthal, 5999 Wood Trail Rd., Memphis, Tenn. 38119; Robert J. Rivers, Box 506, Hwy. 11, Marion, Ark. 72364

[21] Appl. No.: 563,143

[22] Filed: Nov. 27, 1995

[51] Int. Cl.[6] ..... A47B 47/00

[52] U.S. Cl. ..... 312/265.4; 312/3; 211/181; 108/110; 108/144

[58] Field of Search ..... 312/5, 3, 4, 6, 312/265.1, 265.4; 211/181, 187; 108/101, 96, 107, 106, 110, 181, 193, 144, 159, 187; 403/353, 403, 205; 256/65

[56] References Cited

U.S. PATENT DOCUMENTS

| | | | |
|---|---|---|---|
| 180,480 | 8/1876 | Klobassa | 312/3 |
| 340,949 | 4/1886 | Jackson | 108/144 |
| 719,060 | 1/1903 | Thomas . | |
| 840,512 | 1/1907 | Palmer . | |
| 890,554 | 6/1908 | Blackstone . | |
| 941,653 | 11/1909 | Rothengatter . | |
| 1,366,743 | 1/1921 | O'Connor . | |
| 2,168,172 | 8/1939 | Rees | 108/107 X |
| 3,232,442 | 2/1966 | Wilson . | |
| 3,343,506 | 9/1967 | Buchbinder et al. . | |
| 3,654,879 | 4/1972 | Ferdinand et al. . | |
| 3,705,654 | 12/1972 | Barrineau, III | 211/187 |
| 3,734,032 | 5/1973 | Kovacik | 211/187 X |
| 3,797,903 | 3/1974 | Traulsen | 108/144 X |
| 4,109,567 | 8/1978 | Gage et al. . | |
| 4,231,301 | 11/1980 | Barrineau, III . | |
| 4,371,221 | 2/1983 | Citterio . | |
| 4,391,378 | 7/1983 | Secon | 211/181 X |
| 4,595,107 | 6/1986 | Welsch . | |
| 4,694,966 | 9/1987 | Sorenson et al. . | |
| 5,027,959 | 7/1991 | Luukkonen . | |
| 5,251,973 | 10/1993 | Hazan . | |
| 5,325,973 | 7/1994 | Reedy . | |
| 5,450,971 | 9/1995 | Boron et al. . | |

FOREIGN PATENT DOCUMENTS

| | | | |
|---|---|---|---|
| 1236769 | 6/1960 | France | 312/3 |
| 552361 | 6/1974 | Switzerland . | |
| 364161 | 1/1932 | United Kingdom | 211/147 |
| 796180 | 6/1958 | United Kingdom | 108/144 |

OTHER PUBLICATIONS

Lee/Rowan Models 5145, c5145 & 85501 Wardrobe Organizer, Assembly Instructions Organize–It–All, Inc. Wardrobe Assembly Instructions, 1993.

Advertisement, Williams–Sonoma, Slipcovered Wardrobe Advertisement.

*Primary Examiner*—Peter M. Cuomo
*Assistant Examiner*—Janet M. Wilkens
*Attorney, Agent, or Firm*—Peter J. Georges

[57] ABSTRACT

A wardrobe frame is described which comprises a hanging section and a shelf section formed from elongated connection pieces and poles inserted into holes at the ends thereof. The poles in the back of the shelf section have transversely disposed holes therein, and the poles in the front of the shelf section have obliquely disposed holes therein. The top shelf has a linearly extending prong at each of its back corners. The lower shelves have an upwardly extending prong at each of their back corners. All of the shelves have a downwardly extending prong at each of their front corners. The linearly extending prongs and the upwardly extending prongs fit into the transversely disposed holes, and the downwardly extending prongs fit into the obliquely disposed holes.

26 Claims, 4 Drawing Sheets

PORTABLE WARDROBE FRAME

FIELD OF THE INVENTION

This invention relates to light, easily erectable, collapsible, and sturdy wardrobes, armoires, and storage closets that can be assembled and disassembled by a single person and especially relates to frames therefor.

BACKGROUND OF THE INVENTION

Collapsible wardrobes, armoires, and storage closets have been known and used for many years.

For example, U.S. Ser. No. 890,554 describes a collapsible wardrobe comprising a rectangular peripheral frame over which is stretched cloth, leather, or tough paper to provide a hollow inner space having the frame as a rim at its edges for holding a shelf extending across between the frame edges, thereby holding the wardrobe rigidly open. The shelf is made of spaced-apart slats that receive coat hooks for suspending garments. The slats have holes in each end through which a pair of rods are inserted, one rod being pivotally attached to the upright frame, and the other rod being hung from a J-shaped hook.

Swiss Patent 552,361 discloses another collapsible wardrobe having a frame that comprises four molded plastic connection pieces, four upright outer frame poles, six transverse poles, and a cloth or plastic cover having a pair of zippers that traverse the top, bottom and one side to form a front door. An additional connection piece may be inserted a short distance beneath the top and at the bottom, and two additional upright poles, shorter than the corner poles, may be inserted into this additional piece to support it and to support a plurality of horizontally disposed shelves at one side of the wardrobe.

U.S. Pat. No. 4,371,221 describes a composite modular layout structure providing numbers of combinations, including a built-in wardrobe and a partition type of wardrobe, comprising side elements, back elements located in guides at the vertical edges of the side elements, roof and base panels adapted for assembling the side elements and roof and base panels together.

A wardrobe that is available in the United States, identified as "JOLLY" and sold by Williams-Sonoma, 4300 Concorde Road, Memphis, Tenn. 38118, uses the molded plastic connection pieces, frame poles, transverse poles, and cover of Swiss Patent 552,361 as its frame but without the shelves, additional connection piece, and additional upright poles thereof. It further includes bottom and top panels, however, and an upper shelf panel.

A "wardrobe organizer" sold by LEE/ROWAN, 6333 Etzel Ave., St. Louis, Mo. 63133, comprises four metal shelves, a single upright pole, two brackets, and joiner plates for attachment to the walls of a closet. Two of the shelves extend to the position of the pole and are attached thereto at a corner. The other two shelves are also attached to the pole but are longer and may be cut to desired lengths.

A wide variety of attachment means for connecting and supporting wire frame shelving to upright poles and other support means are known in the art.

U.S. Ser. No. 719,060, for example, describes a display rack comprising a pair of spaced-apart frame pieces in the form of inverted U's. Rectangular shelves are disposed between the frame pieces and are formed by front, back, and side wire rods, having ends that are wrapped around the upright portions of the frame pieces, and an array of cross-pieces joining the front and back rods.

U.S. Ser. No. 840,512 relates to a clothes rack that is capable of being supported upon a wall. A plurality of uprights spaced apart and connected at upper and lower ends by cross pieces is attached to the wall. An outwardly projecting longitudinal flange is attached to each upright. The arms of the E-shaped bars to receive the clothes have bent ends to project into holes in the flanges. The arms may be folded downwardly so as not to occupy floor space.

U.S. Ser. No. 941,653 discloses a foldable kitchen rack comprising an upright stem which is attached to a wall and is perforated from side to side at spaced intervals. The stem is flanked by flanges and caries a series of spaced clasps which may be swung either downwardly to extend at an angle from the stem or upwardly to fold against the stem. Each clasp is composed of a single piece of wire bent to form a transverse rear arm, a pair of end loops, upright front shanks, heels, and pintles. The two pintles of each clasp are slipped from opposite directions into one of the perforations in the upright stem. The clasps may be folded against the stem when not in use.

U.S. Pat. No. 1,366,743 is directed to sectional metallic shelving in which the shelves are supported upon and detachably attached to rods or bars extending from one upright or partition to the next. Box-like face strips have bottle neck slots formed therein for reception of the shelf hooks, with the intermediate section being of increased thickness.

U.S. Pat. No. 3,232,442 relates to a mobile, collapsible storage rack in which the merchandise is held and displayed on inclined trays. The display and storage rack includes a plurality of upright supports, formed from a pair of tubular members in the shape of an inverted U, that are apertured to receive and mount a plurality of shelf brackets. A plurality of wire-formed shelf brackets include a first rod-like member extending along the length of the bracket and having a bent-over end portion which extends sideways through an aperture in the corresponding upright support, whereby the brackets are mounted in an inclined manner between the upright supports. A retaining nut is removably mounted on the protruding end of each of the bent-over end portions. A plurality of wire-formed trays are mounted on the shelf brackets.

U.S. Pat. No. 3,343,506 relates to insertable shelving, comprising four vertical posts having rectangularly elongated openings in the rear sides thereof. Each shelf, of the wire grill type, has a pair of laterally spaced and forwardly projecting prongs or fingers that are rigidly mounted thereon and receivable in the openings in the front pair of posts. These prongs are in the form of laterally offset portions of bars which are secured to the outer sides of the shelf, a retaining slot being provided in the lower edge of each prong to receive the wall of the post. The rear portion of each shelf is similarly equipped with rearwardly projecting prongs or fingers on laterally offset portions of bars for insertion in the openings in the rear pair of posts.

U.S. Pat. No. 3,654,879 relates to knockdown steel shelving wherein each corner of a shelf is provided with a slidably mounted hook member that extends into the cut-out corner of the shelf. The hook members are guided within the box flange for retraction to clear an upright support member for level adjustment and then tightened to a retracted position by a cam.

U.S. Pat. No. 3,797,903 relates to a refrigerator including four notched posts and a plurality of shelves that fit into the notches.

U.S. Pat. No. 4,109,567 describes a camp grill for cooking over an open fire. The grill has a top with hollow cylindrical leg holders, each telescopically receiving one of the four legs. Each leg has axially spaced, radially and outwardly extending lugs disposed in alignment with each other. Each leg holder has a slot therein that fits over a lug. To adjust the height of the grill, the leg holders can be adjusted by aligning them with the slots in the cylindrical holders, sliding the legs to the proper vertical position, and rotating them so that the lugs underlie the holders.

U.S. Pat. No. 4,231,301 shows a four-corner post adjustable shelf assembly having a flexible latch structure composed of a flex arm with a latch finger mounted on one end, the flex arm being connected to the shelf at the other end. The installer manually flexes the flex arms out of the connect position and releases them when the latch fingers are disposed adjacent to selected holes in the corner posts.

U.S. Pat. No. 4,391,378 relates to knock-down shelving consoles that may be stacked horizontally and vertically. Each console comprises a pair of side frame support standards formed by a pair of laterally spaced wire frame members bent into a rectangular shape. Positioned between and interconnecting these frame members are a multiplicity of U-shaped connecting members which appear as equally spaced rungs on a ladder. Shelves may be of multi-wire type or may comprise a wire frame and a planar shelf member supported by the wire frame. For every shelf or wire frame, the corners of the intersection of the respective adjacent border members include hook-shaped connectors which preferably have a pair of laterally offset legs interconnected by a substantially horizontal leg. The legs project downwardly and are positioned within selected ones of the U-shaped connecting members.

U.S. Pat. No. 4,595,107 pertains to knock-down utility carts for use in hospitals, hotels, schools, and the like. This cart comprises four corner posts, upper and lower shelves, a single handle, and four casters. The corner posts are formed of straight tubing. A stacked series of split support collars surrounds each corner post. The exterior surface of each collar tapers outwardly downwardly so that mating sleeves at the corners of the lower shelf closely engage those surfaces, whereby the shelf is supported horizontally.

U.S. Pat. No. 4,69,966 relates to a wire-formed display tray attachable in cantilever fashion to a perforated vertical support panel, commonly known as pegboard. A first set of wires is arranged in spaced parallel arrangement in one plane forming the bottom of the tray. The rear portions of these wires extend diagonally rearwardly and upwardly in a second plane which is obtuse to the plane of the tray bottom. The outer two of the wires extend further than the others, and their rear ends are offset in L-shaped fashion to be inserted through holes in the perforated support panel and bear against the inner surface of the panel.

U.S. Pat. No. 5,027,959 relates to a rack arrangement for storing goods in shops, warehouses, homes, and the like. The rack comprises vertically disposed corner poles and horizontal wire-formed shelves that are attached by fastening members to the corner poles. A fastening member includes a first gripping member for attaching the fastening member detachably to a corner pole and a second gripping member for attaching a shelf detachably to the fastening member. The first gripping member comprises a sideways and outwardly open vertical groove, and the second gripping member comprises an upwards open lengthwise groove and an upwards open transversal groove.

U.S. Pat. No. 5,251,973 discloses a shelving unit comprising a pair of planar side members, each having a pair of closely vertically spaced horizontal rods extending between forward and rear vertical legs of the side member. The unit also comprises a pair of shelf members with U-shaped hook members on opposed sides that are adapted to engage the horizontal rods. The U-shaped hooks extend upwardly, normal to the shelf surfaces, and then downwardly so that the open ends of the U's face downwardly and extend over a pair of the horizontal rods.

U.S. Pat. No. 5,325,973 relates to a bicycle support rack that includes a shelf piece and a U-shaped bracket. The shelf piece has a pair of downwardly extending members at its rear corners for attachment to a wall and a pair of downwardly and then upwardly curved members at its front corners for supporting a bicycle.

U.S. Pat. No. 5,450,971 relates to an adjustable shelf structure adaptable for use in combination with existing refrigerated display coolers. The shelf structure comprises a grid of rod members and a slidably attached hook member at each corner. Each hook member comprises an eyelet engaging one of the rod members and angularly related members that engage any one of a plurality of vertically spaced hooks, openings, and similar attachment means commonly associated with the upright support members utilized in known cooler systems.

Although these known wardrobe frames and known attachment means have useful features, they generally lack a plurality of shelves having simple attachment means that can be inexpensively manufactured and easily installed by a purchaser, while furnishing additional rigidity to the entire frame.

SUMMARY OF THE INVENTION

It is an object of this invention to provide a wardrobe frame that comprises a plurality of shelves that are easily engaged with the frame and disengaged therefrom to form a shelf section within the frame.

It is a particular object to provide a wardrobe frame comprising a plurality of upright poles having a spaced array of holes and a plurality of shelves comprising an attachment means at each corner for selectively attaching the shelves to the poles by insertion of the attachment means into the holes.

It is also an object to provide a wardrobe frame comprising a top shelf having a pair of prongs extending in the plane of the shelf, at two adjacent corners, and a pair of prongs extending downwardly beyond the shelf, at two adjacent corners, as the attachment means.

It is another object to provide a wardrobe frame comprising a plurality of lower shelves that each have a pair of prongs extending upwardly beyond the shelf, at two adjacent corners, and a pair of prongs extending downwardly beyond the shelf, at two adjacent corners, as the attachment means.

It is an additional object to provide a wardrobe frame comprising upright poles having a plurality of transversely cut holes therein for insertion of the plane-extending prongs or of the upwardly extending prongs and support of the shelves therewith.

It is further an object to provide a wardrobe frame comprising upright poles having a plurality of obliquely disposed and indented holes therein for insertion of the downwardly extending prongs and support of the shelves therewith.

According to the principles and objects of this invention, the wardrobe frame of this invention comprises a hanging section and a shelf section wherein a plurality of shelves provide additional rigidity and support to the wardrobe as well as space for storing folded garments and the like.

The shelf section is framed by four upright poles, four molded plastic connection pieces into which the four upright poles are inserted at their ends to form a top and a bottom, two pairs of horizontally extending poles that are inserted into the top and bottom connection pieces at right angles to the upright poles, a top shelf having a pair of prongs at adjacent corners that extend in the plane of the shelf and a pair of prongs at adjacent corners that extend downwardly beyond the shelf, and a plurality of lower shelves that each have a pair of prongs at adjacent corners that extend upwardly beyond the shelf and a pair of prongs at adjacent corners that extend downwardly beyond the shelf.

Two of the four upright poles have transversely disposed holes therein. These poles are conveniently disposed in the rear of the assembled wardrobe. The remaining two upright poles have obliquely disposed holes with a slopingly indented entrance portion on one side and a raised portion on the other side. These poles are conveniently disposed in the front of the assembled wardrobe, with the sloping entrance above the hole. However, the poles having indented holes may be placed in the rear of the wardrobe, and the poles having transversely disposed holes may be placed in the front thereof, if desired.

The hanging section is also framed by four upright poles and four molded plastic connection pieces, but two of the poles and two of the connection pieces are shared pieces with the shelf section. The other two poles have no holes therein and form two outer corners of the assembled wardrobe. The two unshared upright poles having holes therein form the other two outer corners of the assembled wardrobe. The shared poles form corners of both the shelf section and the hanging section. All of the upright poles are formed by axially joining two short poles.

The two pairs of horizontally extending poles that are inserted into the top and bottom connection pieces at right angles to the upright poles also extend through the hanging section so that they extend from corner to corner at both top and bottom of the wardrobe frame. A short pole is also inserted into the centers of the upper connection pieces, and another short pole is inserted into the centers of the lower connection pieces.

The poles are preferably made from thin metal tubes but may be made from tubular rigid plastic or may be made of solid plastic poles or of wood if suitable holes are cut transversely or obliquely therein and if these holes have sufficient depth to accommodate movement of the bent prongs as they are inserted thereinto.

The wardrobe frame of this invention may also be described as having four corners, two of the corners being designated as back corners and two being designated as front corners as a matter of convenience only, comprising:

A) a hanging section and a shelf section;

B) two pairs of molded plastic connection pieces, forming top and bottom side edges of the wardrobe frame and having holes therein at the ends thereof and at the corners of the wardrobe frame;

C) a back pair of upright corner poles that are inserted into a pair of the holes in the edge connection pieces to form a back corner of the hanging section and a back corner of the shelf section;

D) a front pair of upright corner poles that are inserted into a pair of the holes in the edge connection pieces to form a front corner of the hanging section and a front corner of the shelf section;

E) one pair of molded plastic connection pieces, having holes therein at the ends thereof, that are disposed intermediate the top and bottom side edges and are shared between the hanging section and the shelf section;

F) a front upright shared pole and a back upright shared pole that are inserted into the holes in the shared connection pieces;

G) a plurality of transversely disposed holes in the back upright shared pole and in the back upright corner pole of the shelf section;

H) a plurality of obliquely disposed and indented holes in the front upright shared pole and in the front upright corner pole of the shelf section, the transversely disposed holes and the obliquely disposed holes being aligned to define a plurality of parallel horizontal planes; and I) a plurality of shelves, comprising:

1) a top shelf having a pair of prongs extending in the plane of the shelf and disposed in two adjacent corners thereof, for insertion into one pair of said transversely cut holes, and a pair of prongs extending downwardly beyond the shelf and disposed in the front corners thereof, for insertion into one pair of said obliquely disposed holes, and 2) a plurality of lower shelves that each have a pair of prongs extending upwardly beyond the shelf and disposed in two adjacent corners thereof, for insertion into a pair of the transversely disposed holes, and a pair of prongs extending downwardly beyond the shelf and disposed in two adjacent corners thereof, for insertion into a pair of the obliquely disposed holes.

The upwardly extending prongs in the shelves are at an angle of approximately 72° to the shelves. The downwardly extending prongs in the shelves are at an angle of approximately 60° to the shelves.

In this wardrobe frame, an upper short pole and a lower short pole are inserted into the central holes in the upper and lower edge connection pieces of the hanging section and into the central holes in the upper and lower shared connection pieces, whereby garments may be hung from the upper short pole.

DESCRIPTION OF THE PREFERRED EMBODIMENTS

Figure 1:
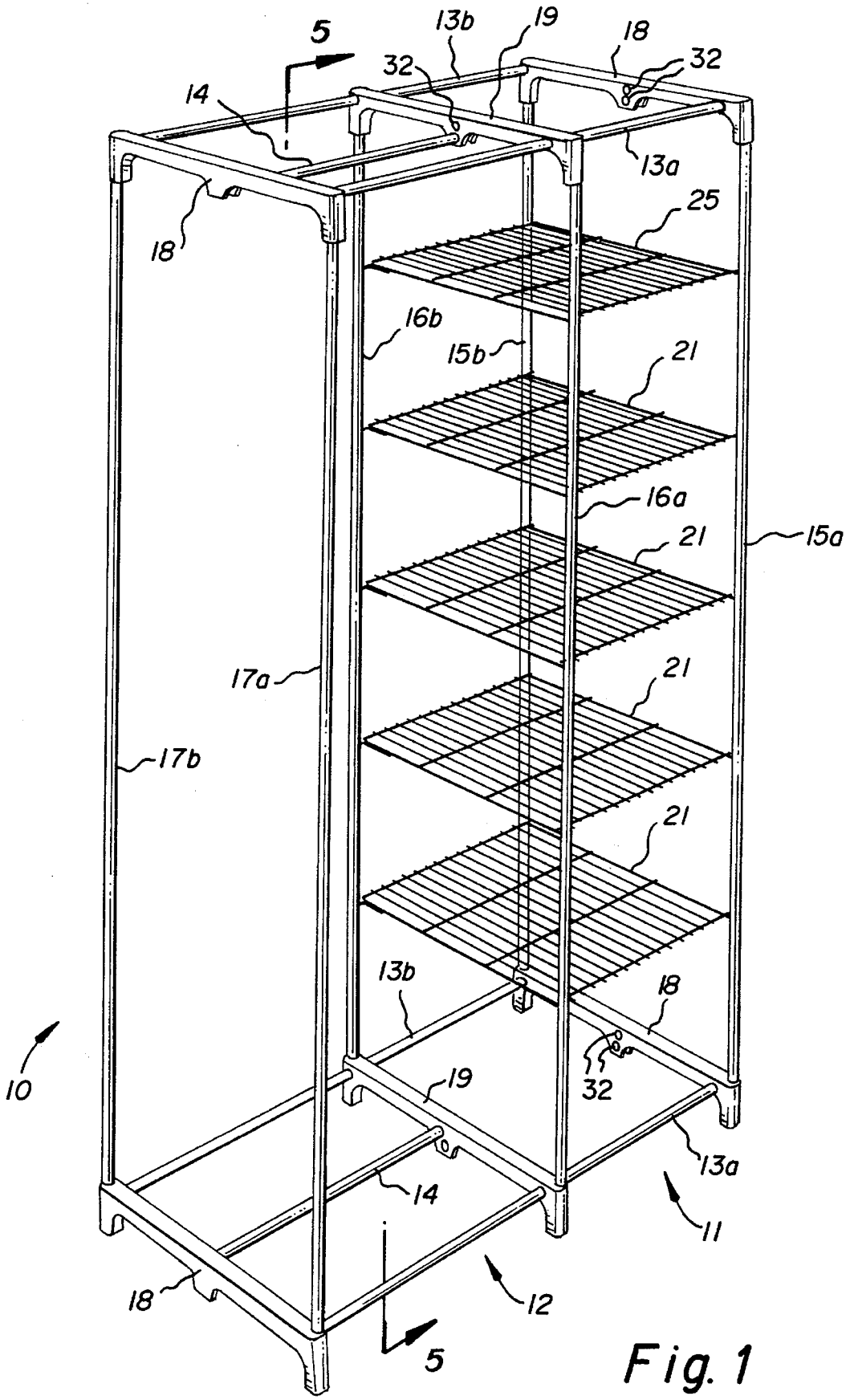
FIG. 1 is a perspective view of the assembled wardrobe frame without its cover.
Figure 2:
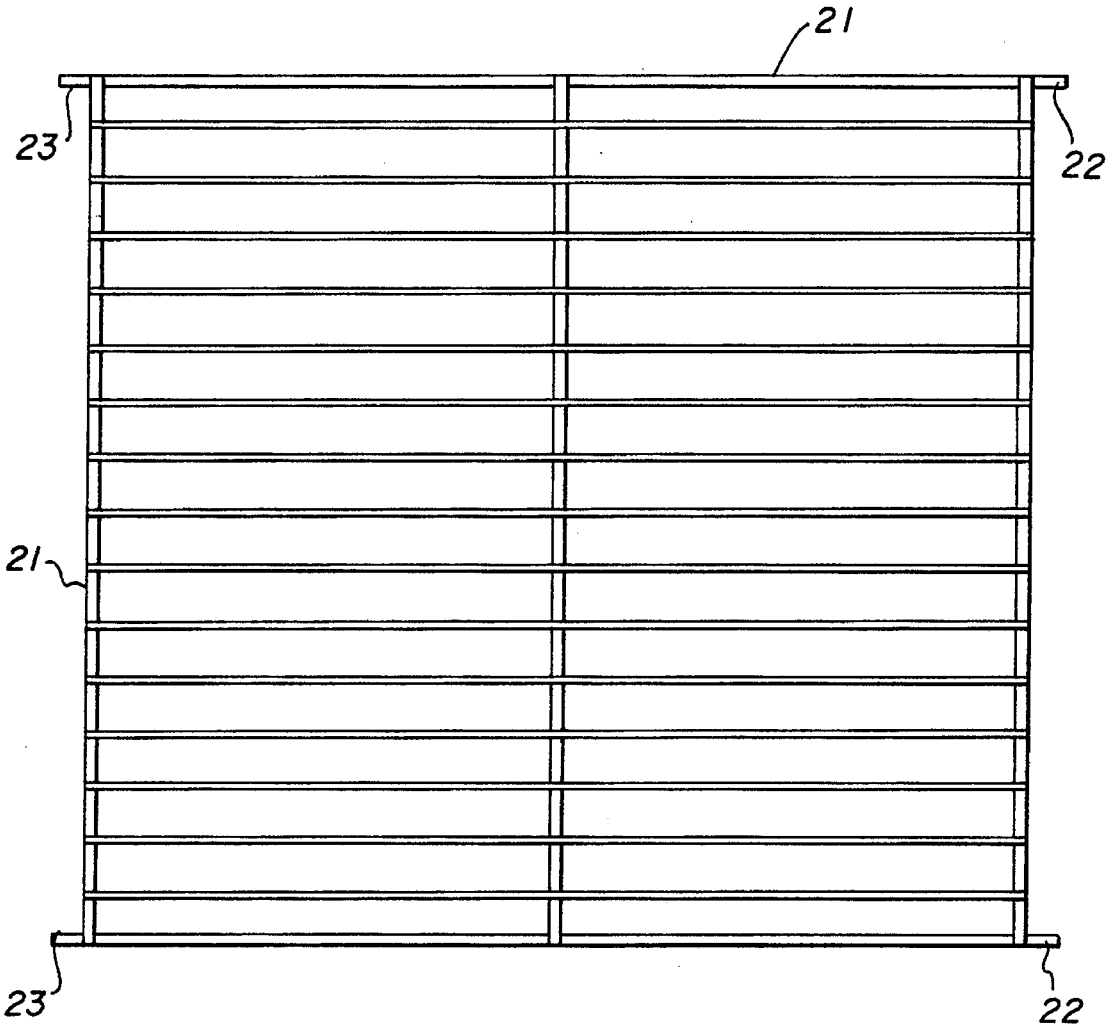
FIG. 2 is a plan view of a rigid wire shelf disposed beneath the top shelf.
Figure 3:
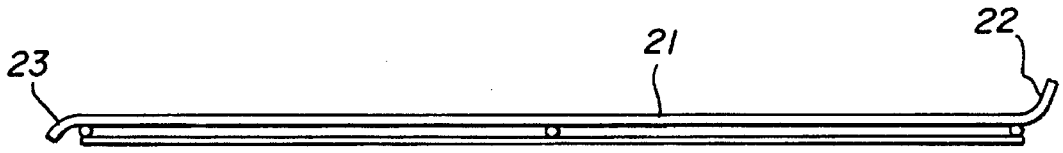
FIG. 3 is a side view of the shelf of FIG. 2, viewed upside down.
Figure 4:
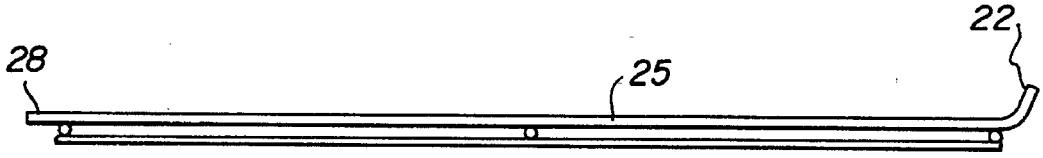
FIG. 4 is a side view of a shelf used as the top shelf, viewed upside down.
Figure 5:
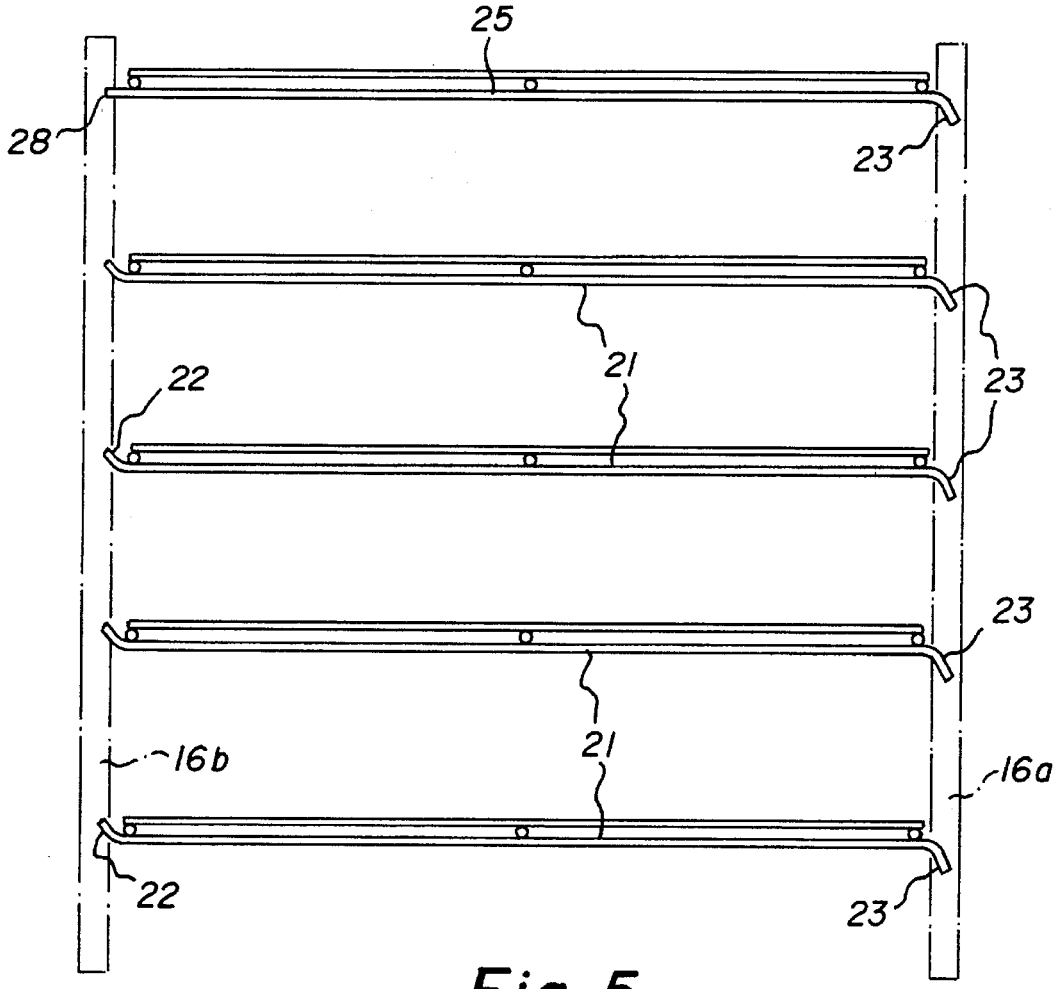
FIG. 5 is a schematic side view of the shelf section, looking in the direction of the arrows 5—5 in FIG. 1, that illustrates the connections of the shelves with the upright poles.

Wardrobe frame 10 comprises hanging section 12 and shelf section 11 wherein a plurality of shelves 21, 25 provide additional rigidity and support to wardrobe frame 10 as well as space for storing folded garments and the like.

Shelf section 11 is framed by four upright poles 15*a*, 15*b*, 16*a*, 16*b*, four elongated connection pieces 18 and 19 into which the four upright poles are inserted at their ends to form a top and a bottom two pairs of horizontally extending poles 13*a* and 13*b* that are inserted into the top and bottom connection pieces 18, 19 at right angles to the upright poles, a top shelf 25 having a pair of prongs 28 extending in the plane of the shelf and a pair of prongs 23 extending downwardly beyond the shelf, and a plurality of lower shelves 21 that each have a pair of prongs 22 extending upwardly beyond the shelf and a pair of prongs 23 extending downwardly beyond the shelf.

Figure 7:
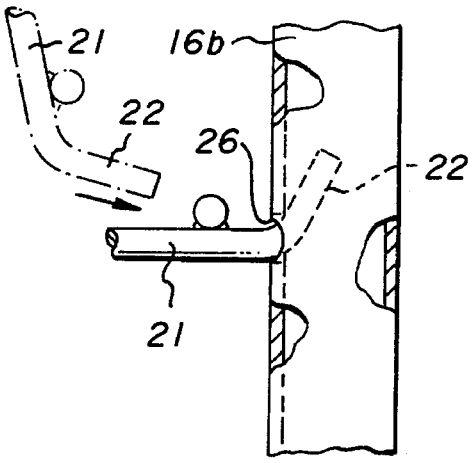
FIG. 7 is a side view of an upright pole having a transversely disposed hole therein, showing an upwardly extending prong approaching the hole and then resting within the hole.

Two of the four upright poles have transversely disposed holes 26 therein. These poles 15*b* and 16*b* are suitably disposed in the rear of the assembled wardrobe frame. FIG. 7 illustrates the positioning of a lower shelf 21 as a prong 22 approaches a hole 26 and then rests within it.

Figure 6:
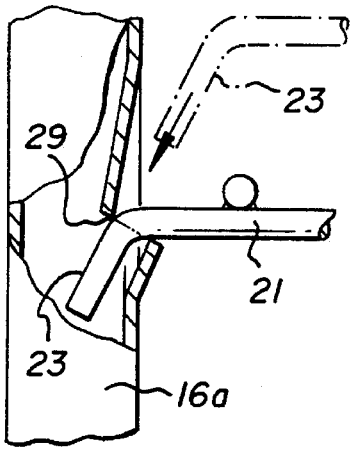
FIG. 6 is a partial sectional view of an obliquely disposed hole in an upright pole disposed in the front of the shelf section, showing a downwardly extending prong approaching the hole and then resting within it.

The remaining two upright poles 15*a* and 16*a* have obliquely disposed holes 29 therein with a sloping or indented entrance above the hole and a protrusion below the hole. These poles are suitably disposed in the front of the assembled wardrobe frame. FIG. 6 illustrates the positioning of a lower shelf 21 as a prong 23 approaches a hole 29 and then rests within it.

Hanging section 12 is also framed by four upright poles 16*a*, 16*b*, 17*a*, 17*b* and four elongated connection pieces 18 and 19, but two of the poles (16*a*, 16*b*) and two of the connection pieces (19) are shared pieces with shelf section 11. The other two poles 17*a*, 17*b* have no holes therein and form two outer corners of the assembled wardrobe frame. The two unshared upright poles 15*a*, 15*b* having holes 26, 29 therein form the other outer corners of assembled wardrobe frame 10. All of the upright poles are formed by linearly joining two short poles.

The two pairs of horizontally extending poles 13*a*, 13*b* that are inserted into the top and bottom connection pieces 18, 19 at right angles to the upright poles also extend through hanging section 12 so that they extend from corner to corner at both top and bottom of wardrobe frame 10. A short pole 14 is also inserted into the centers of the upper connection pieces 18 and 19, and another short pole 14 is inserted into holes 32 in the centers of the upper and lower connection pieces 18 and 19 of hanging section 12.

Angle 24 for upwardly extending prongs 22 in lower shelves 21 is approximately 60° but may be as small as 55°. Angle 27 for downwardly extending prongs 23 in lower shelves 21 and top shelf 25 is 72° but may be as small as 67°. Prongs 28 are straight because there is insufficient space above this shelf to tilt it as indicated in FIG. 7 for insertion of upwardly extending prongs 22 into transversely disposed holes 26. Prongs 23 are downwardly inserted into obliquely disposed holes 29, as shown in FIG. 6.

Shelves 21, 25 are wire formed and comprise a closely spaced array of wires for supporting articles placed thereon. Preferably, the two attachment wires terminating in prongs 22, 23, 28 are 6-gauge wire. Mounted upon and perpendicularly attached to them are three 6-gauge wires. Mounted upon and perpendicularly attached to them are 15 12-gauge wires.

Figure 8:
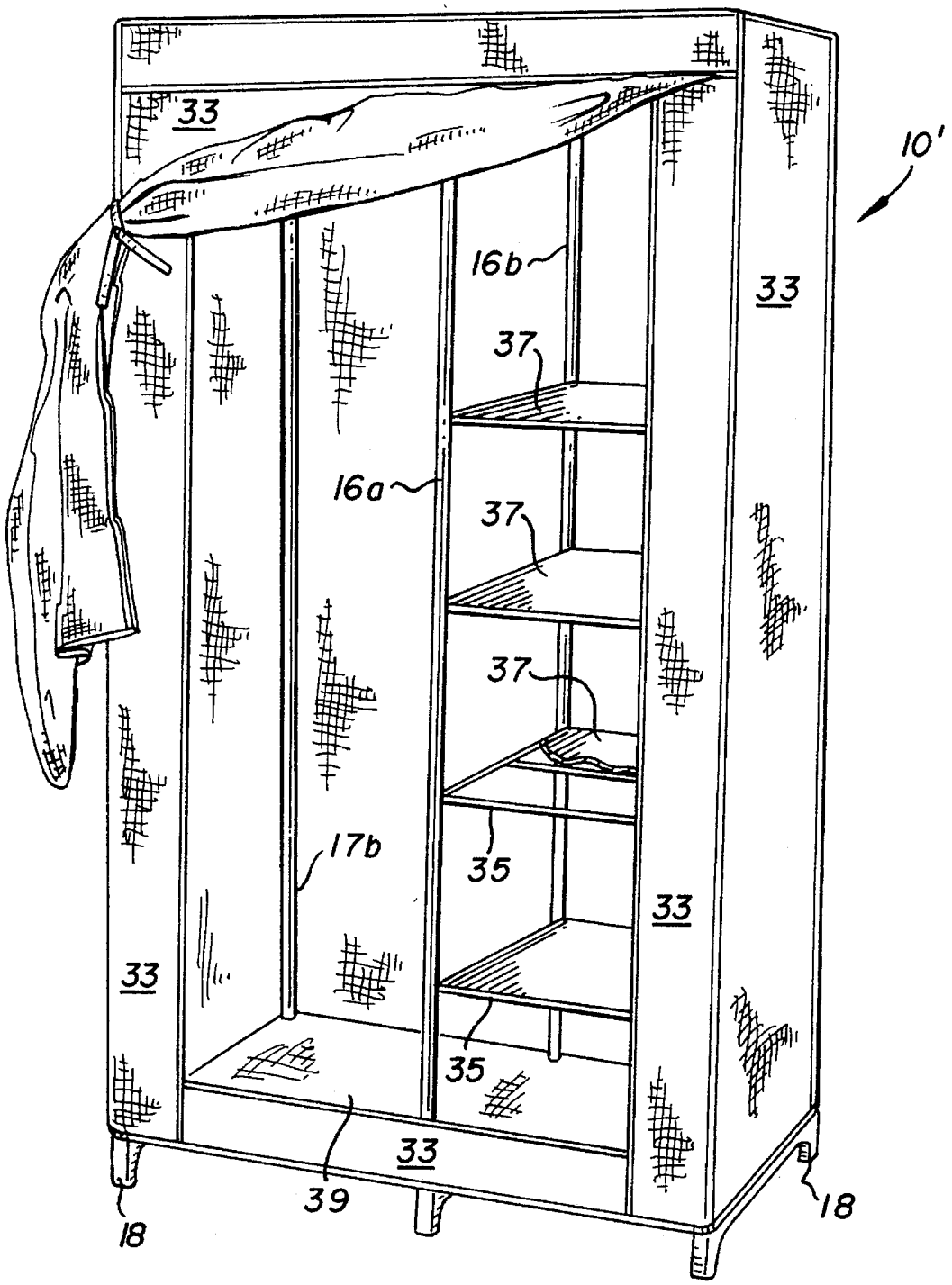
FIG. 8 is a perspective view of another embodiment of the invention that includes four shelves, each having three support wires beneath the two attachment wires that terminate in prongs and a hardboard panel resting on the three support wires, the entire frame being enclosed within a cloth cover.

The alternate and preferred embodiment 10' shown in FIG. 8 comprises four shelves 35 that are also wire formed, with prongs 22, 23. However, they have three 6-gauge support wires, perpendicularly attached beneath the two 6-gauge attachment wires terminating in prongs 22, 23, for supporting hardboard panels 37 thereupon. A hardboard panel 39 covers the entire bottom of the frame. The complete frame 10' is shown with its cloth cover 33, ready for consumer use.

It is apparent that numerous variations of the preferred embodiments described hereinbefore may be utilized. However, all such variations that are within the spirit and scope of the invention are deemed to be covered by the following claims.

What is claimed is:

1. A wardrobe frame having four corners, comprising:

A) a hanging section and a shelf section;

B) two pairs of elongated connection pieces, forming top and bottom side edges of said wardrobe frame, each said piece having a perpendicularly disposed hole therein at each end thereof and at said corners of said wardrobe frame;

C) a back pair of upright corner poles that are inserted into said pair of perpendicularly disposed holes in said connection pieces to form a back corner of said hanging section and a back corner of said shelf section;

D) a front pair of upright corner poles that are inserted into said pair of perpendicularly disposed holes in said connection pieces to form a front corner of said hanging section and a front corner of said shelf section;

E) a third pair of elongated connection pieces, each said piece having a perpendicularly disposed hole therein at each end thereof, that are disposed intermediate said top and bottom side edges and are shared between said hanging section and said shelf section;

F) a front upright shared pole and a back upright shared pole that are inserted into said holes in said shared connection pieces;

G) a plurality of transversely disposed holes in said back upright shared pole and in said back upright corner pole of said shelf section;

H) a plurality of obliquely disposed holes in said front upright shared pole and in said front upright corner pole of said shelf section, said transversely disposed holes and said obliquely disposed holes being aligned to define an array of parallel horizontal planes; and I) a plurality of shelves within said shelf section, comprising:

1) a top shelf having a pair of prongs extending in the plane of said shelf and disposed at the back corners thereof, for insertion into the topmost pair of said transversely disposed holes, and a pair of prongs extending downwardly beyond said shelf and disposed at the front corners thereof, for insertion into the topmost pair of said obliquely disposed holes, and 2) a plurality of lower shelves that each have a pair of prongs extending upwardly beyond said shelf and disposed at the back corners thereof, for insertion into a pair of said transversely disposed holes, and a pair of prongs extending downwardly beyond said shelf and disposed at the front corners thereof, for insertion into a pair of said obliquely disposed holes.

2. The wardrobe frame of claim 1, wherein said upwardly extending prongs in said shelves are at an angle of approximately 72° to said shelves.

3. The wardrobe frame of claim 1, wherein said downwardly extending prongs in said shelves are at an angle of approximately 60° to said shelves.

4. The wardrobe frame of claim 1, wherein each said elongated connection piece has a perpendicularly disposed central hole disposed at 90° to said corner holes.

5. The wardrobe frame of claim 4, wherein an upper short pole and a lower short pole are inserted into said central holes in said upper and lower edge connection pieces of said hanging section and into said central holes in said upper and lower shared connection pieces, whereby garments may be hung from said upper short pole within said hanging section.

6. The wardrobe frame of claim 1, wherein said shelves are wire formed and comprise a closely spaced array of wires for supporting articles placed thereon.

7. The wardrobe frame of claim 1, wherein said shelves are wire formed and comprise a hardboard panel for supporting articles placed thereon.

8. A wardrobe frame, having a front and a back and four corners, comprising a hanging section and a shelf section, said shelf section comprising:

A) a plurality of elongated connection pieces and a plurality of poles inserted uprightly into holes therein, said poles in the back of said shelf section having transversely disposed holes therein and the poles in the front of said shelf section having obliquely disposed holes therein; and B) a plurality of shelves having an upwardly extending prong at each of the back corners thereof and a downwardly extending prong at each of the front corners thereof, whereby said upwardly extending prongs fit into said transversely disposed holes and said downwardly extending prongs fit into said obliquely disposed holes.

9. The wardrobe frame of claim 8, wherein a top shelf, in addition to said plurality of shelves therebeneath, has a linearly extending prong at each of the back corners thereof and a downwardly extending prong at each of the front corners thereof, whereby said linearly extending prongs fit into said transversely disposed holes and said downwardly extending prongs fit into said obliquely disposed holes.

10. The wardrobe frame of claim 8, wherein said upwardly extending prongs in said shelves are at an angle of approximately 72° to said shelves.

11. The wardrobe frame of claim 8, wherein said downwardly extending prongs in said shelves are at an angle of approximately 60° to said shelves.

12. The wardrobe frame of claim 8, wherein said elongated connection pieces have a central hole disposed at 90° to said holes.

13. The wardrobe frame of claim 8, wherein said shelves are wire formed and comprise a closely spaced array of wires for supporting articles placed thereon.

14. The wardrobe frame of claim 8, wherein said shelves are wire formed and comprise a hardboard panel for supporting articles placed thereon.

15. In an array of stacked horizontal shelves having front and back corners and supported at the back corners in removable engagement with two spaced-apart poles at the rear of said shelves and two spaced-apart poles at the front of said shelves, said poles supporting said shelves at preselected stacked intervals, the improvement which comprises a series of transversely disposed holes along the length of said two rear poles, a series of obliquely disposed holes along the length of each of said two front poles, an upwardly extending prong at each of the back corners of said shelves and a downwardly extending prong at each of the front corners of said shelves, whereby said upwardly extending prongs fit into said transversely disposed holes and said downwardly extending prongs fit into said obliquely disposed holes.

16. The array of claim 15, wherein a top shelf, in addition to said array of stacked horizontal shelves therebeneath, has a linearly extending prong at each of the back corners thereof and a downwardly extending prong at each of the front corners thereof, whereby said linearly extending prongs fit into said transversely disposed holes and said downwardly extending prongs fit into said obliquely disposed holes.

17. The array of claim 15, wherein said upwardly extending prongs in said shelves are at an angle of approximately 72° to said shelves.

18. The array of claim 15, wherein said downwardly extending prongs in said shelves are at an angle of approximately 60° to said shelves.

19. The array of claim 15, wherein said shelves are wire formed and comprise a closely spaced array of wires for supporting articles placed thereon.

20. The array of claim 15, wherein said shelves are wire formed and comprise a hardboard panel for supporting articles placed thereon.

21. An attaching means comprising:

A) a plurality of horizontal shelves having four corners and disposed in vertically spaced-apart array;

B) two pairs of vertically disposed poles situated at said corners of said shelves; and C) transversely disposed holes spaced along the lengths of an adjacent pair of said poles and obliquely disposed holes spaced along the lengths of the other adjacent pair of said poles, said shelves having an upwardly extending prong at each of two adjacent corners thereof and a downwardly extending prong at each of the remaining two adjacent corners thereof, whereby said upwardly extending prongs fit into said transversely disposed holes and said downwardly extending prongs fit into said obliquely disposed holes.

22. The attaching means of claim 21, wherein a top shelf is disposed above said plurality of shelves and has a linearly extending prong at each of two adjacent corners thereof and a downwardly extending prong at each of the remaining two adjacent corners thereof, whereby said linearly extending prongs fit into said transversely disposed holes and said downwardly extending prongs fit into said obliquely disposed holes.

23. The attaching means of claim 21, wherein said upwardly extending prongs in said shelves are at an angle of approximately 72° to said shelves.

24. The attaching means of claim 21, wherein said downwardly extending prongs in said shelves are at an angle of approximately 60° to said shelves.

25. The attaching means of claim 21, wherein said shelves are wire formed and comprise a closely spaced array of wires for supporting articles placed thereon.

26. The attaching means of claim 21, wherein said shelves are wire formed and comprise a hardboard panel for supporting articles placed thereon.

* * * * *